US011540634B2

(12) United States Patent
Sun

(10) Patent No.: US 11,540,634 B2
(45) Date of Patent: Jan. 3, 2023

(54) CROSS ROCKING CHAIR

(71) Applicant: Benlong Sun, Jinhua (CN)

(72) Inventor: Benlong Sun, Jinhua (CN)

(73) Assignee: Zhejiang Pride Leisure Products Co,. Ltd., Zhejiang Province (CN)

( * ) Notice: Subject to any disclaimer, the term of this patent is extended or adjusted under 35 U.S.C. 154(b) by 0 days.

(21) Appl. No.: 17/458,603

(22) Filed: Aug. 27, 2021

(65) Prior Publication Data

US 2022/0218109 A1 Jul. 14, 2022

(51) Int. Cl.
*A47C 3/023* (2006.01)
*A47C 4/28* (2006.01)

(52) U.S. Cl.
CPC ..... *A47C 3/023* (2013.01); *A47C 4/283* (2013.01)

(58) Field of Classification Search
CPC ..... A47C 4/283; A47C 7/407; A47C 4/48; A47C 4/28
USPC ..... 297/42, 45
See application file for complete search history.

(56) References Cited

U.S. PATENT DOCUMENTS

| | | | | |
|---|---|---|---|---|
| 9,332,849 | B2 * | 5/2016 | Wagner | A47C 7/02 |
| 10,143,309 | B2 * | 12/2018 | Grace | A47C 7/624 |
| 10,568,430 | B1 * | 2/2020 | Sun | A47C 3/02 |
| 11,172,762 | B2 * | 11/2021 | Zhu | A47C 4/283 |
| 2014/0097647 | A1 * | 4/2014 | Grace | A47C 3/025 297/42 |

* cited by examiner

*Primary Examiner* — Sarah B McPartlin
(74) *Attorney, Agent, or Firm* — WPAT Law, P.C.; Anthony King

(57) ABSTRACT

A cross rocking chair having a chair fabric, a seat frame assembly, a support frame assembly and connectors. The seat frame assembly has two cross tubes, two square seat frame armrest tubes and two backrest support tubes. A cushion and a backrest of the chair fabric are mounted at upper ends of the cross tubes and the backrest support tubes. The support frame assembly has two support frame units each having a support bottom tube. Rear ends of bottom tubes of the seat frame armrest tubes are bent upwards, and front ends of the bottom tubes are arranged on the support bottom tubes. Two ends of each connector are rotatably connected to the top of the bent rear end of the bottom tube of one seat frame armrest tube and the rear end of the corresponding support bottom tube.

12 Claims, 5 Drawing Sheets

CROSS ROCKING CHAIR

BACKGROUND OF THE INVENTION

1. Technical Field

The invention belongs to the technical field of chairs, and particularly relates to a cross rocking chair.

2. Description of Related Art

Traditional chairs are mainly used by users to take a rest and are typically in a steady and fixed state in the horizontal direction, which makes it impossible to adjust the angle between a horizontal cushion and a vertical backrest. If users sit on such chairs for a long time, the users will have their back leaning against the backrest of the chairs and their center of gravity concentrated on the hips and cushion, so the fatigue of the users cannot be effectively relieved, the comfort is poor, and the user experience is poor when the users sit on these chairs for a rest.

BRIEF SUMMARY OF THE INVENTION

The objective of the invention is to overcome the defects of the prior art by providing a cross rocking chair.

To fulfill the aforesaid objective, the technical solution adopted by the invention is as follows: a cross rocking chair comprises a chair fabric, a seat frame assembly, a support frame assembly and connectors, wherein the seat frame assembly comprises two cross tubes, two square seat frame armrest tubes and two backrest support tubes, the two cross tubes are connected in a cross manner and are then rotatably connected to middle portions of the two seat frame armrest tubes, and the top of the rear end of each seat frame armrest tube is connected to one backrest support tube through a back link; a cushion and a backrest of the chair fabric are mounted at the upper ends of the cross tubes and the back support tubes, respectively; the support frame assembly comprises two support frame units each comprising a support bottom tube, the rear ends of bottom tubes of the seat frame armrest tubes are bent upwards, the front ends of the bottom tubes are arranged on the support bottom tubes, and two ends of each connector are rotatably connected to the top of the bent rear end of one seat frame armrest tube and the rear end of the corresponding support bottom tube, respectively.

Further, the back link has an upper contracted portion and a lower contracted portion which are inserted into openings in the tops of the rear ends of one backrest support tube and the corresponding seat frame armrest tube, respectively.

Further, the support frame assembly comprises rocking chair front pads and rocking chair bottom pads, wherein the rocking chair front pads are mounted on the bottom surfaces of the front ends of the support bottom tubes and the rear ends of the support bottom tubes, and when rotating, the bottom tubes of the seat frame armrest tubes abut against the front ends of the support bottom tubes or the upper surfaces of the rocking chair bottom pads.

More further, each support tube comprises a front tube, a middle tube and a rear tube, wherein the rear tube is inserted into the middle tube, and the middle tube is hinged to the front tube through a bottom tube link; and the rocking chair front pads are arranged at the front ends of the front tubes, and the rocking chair bottom pads are arranged at the rear ends of the rear tubes.

More further, the cross rocking chair further comprises front tube pads and bottom tube pads, wherein the front tube pads are disposed around the bottom surfaces of the front tubes, the rocking chair front pads are arranged at the front ends of the bottom surfaces of the front tube pads, and the bottom tube pads are disposed around the bottom surfaces of the middle tubes.

More further, anti-skid grooves are formed in the bottoms of the front tube pads, the bottoms of the bottom tube pads and the bottoms of the rocking chair bottom pads, respectively.

Further, each connector comprises a torsion spring connecting seat, a torsion spring, bearings, a first pin and a second pin, and a U-shaped support piece is arranged at the rear end of each support bottom tube and is formed with a mounting hole; each support bottom tube is formed with a notch corresponding to the front end of the U-shaped support piece, the torsion spring has one end disposed in the notch and the other stretching out of the notch to be clamped in the torsion spring connecting seat, and the torsion spring, the lower end of the torsion spring connecting seat and the U-shaped support piece are rotatably connected through the first pin; a small hollow shaft is arranged at the top of the bent portion of each seat frame armrest tube, the second pin penetrates through the small hollow shafts, and two ends of the second pin are provided with the bearings respectively and are mounted in sliding grooves in two symmetrical faces of the torsion spring connecting seat.

Further, the cross tubes are U-shaped tubes, and two sides of a horizontal rod of each U-shaped tube are riveted to two vertical tubes of one seat frame armrest tube, respectively; the chair fabric is an L-shaped structure formed by the backrest and the cushion, each of two vertical sleeve tubes on two sides of the backrest is disposed around one backrest support tube, and each of two horizontal sleeve tubes on two sides of the cushion is disposed around one horizontal rod; and two vertical rods of each U-shaped tube are riveted to two vertical tubes of the opposite seat frame armrest tube.

Further, the seat frame assembly further comprises four sheaths, two connecting metal pieces and two bent metal pieces, wherein the sheaths are riveted on vertical tubes of the seat frame armrest tubes, the two sheaths on one seat frame armrest tube are connected to the two bent metal pieces, the two sheaths on the other seat frame armrest tubes are connected to the two connecting metal pieces, the other ends of the two connecting metal pieces are riveted to two vertical rods of one cross tube, and the other ends of the two bent metal pieces are riveted to vertical rods of the other cross tube.

More further, the seat frame assembly further comprises four plastic fasteners which are buckled on upper sides of the connecting metal pieces and the bent metal pieces, respectively, and when the two cross tubes are unfolded, horizontal rods of the cross tubes press against the plastic fasteners.

By adoption of the technical solution, the invention has the following beneficial effects: the cross rocking chair has the advantages of being simple in structure, low in overall weight, attractive, firm, durable, and high in practicability; and the cushion and the backrest can be adjusted to a back-tilting state to relieve or eliminate the fatigue of users caused by a long-term upright sitting posture, and the sitting comfort is improved.

In the figures: 1, chair fabric; 11, cushion; 111, horizontal sleeve tube; 12, backrest; 121, vertical sleeve tube; 2, seat frame assembly; 21, cross tube; 22, seat frame armrest tube; 23, backrest support tube; 24, sheath; 25, plastic fastener; 26, back link; 27, small hollow shaft; 3, support frame assembly; 31, support bottom tube; 32, front tube; 33, rear tube; 34, notch; 35, rocking chair front pad; 36, rocking chair bottom pad; 37, bottom tube pad; 38, front tube pad; 39, anti-skid groove; 310, bottom tube link; 311, middle tube; 312, U-shaped support piece; 4, connecting metal piece; 41, bent metal piece; 5, connector; 51, torsion spring connecting seat; 52, torsion spring; 53, lateral bearing cap; 54, bearing; 55, sliding groove;

DETAILED DESCRIPTION OF THE INVENTION

To gain a better understanding of the technical solutions of the invention, specific solutions and embodiments of the invention will be further expounded below in conjunction with the accompanying drawings.

Figure 1:
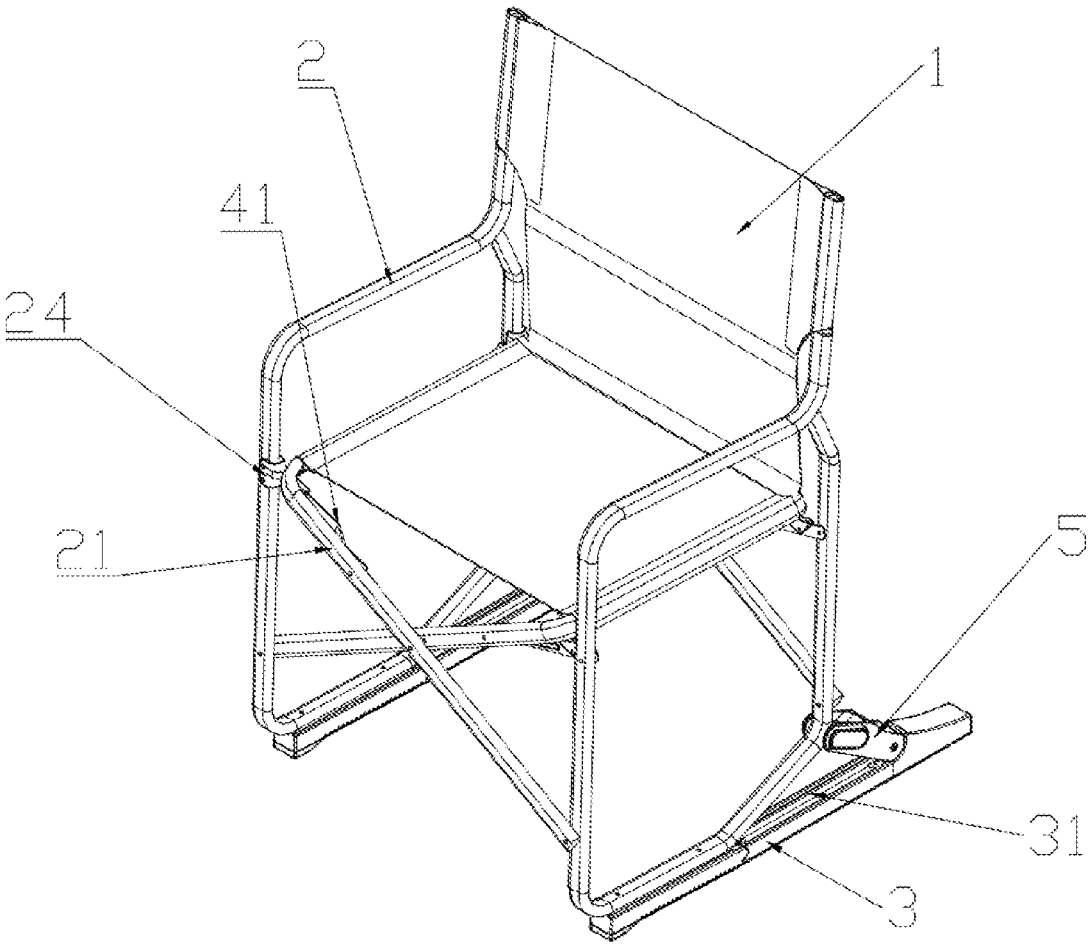
FIG. 1 is a front structural view of a cross rocking chair.
Figure 2:
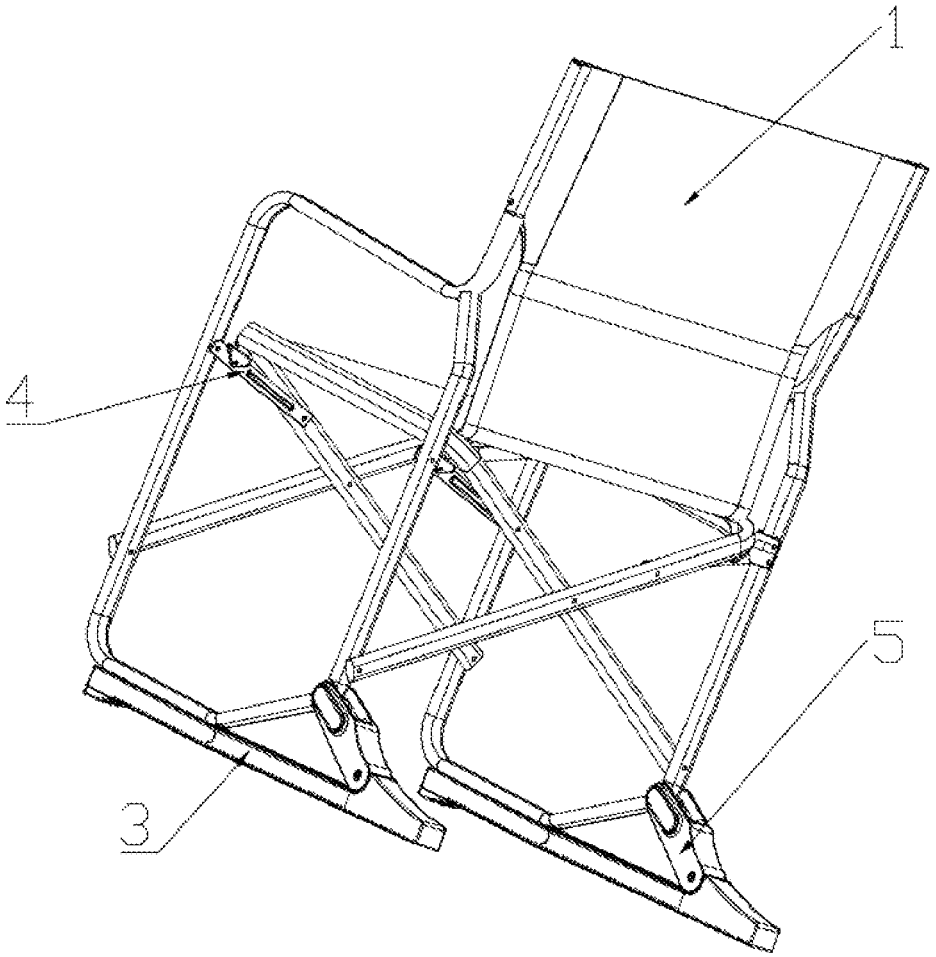
FIG. 2 is a back structural view of the cross rocking chair.
Figure 3:
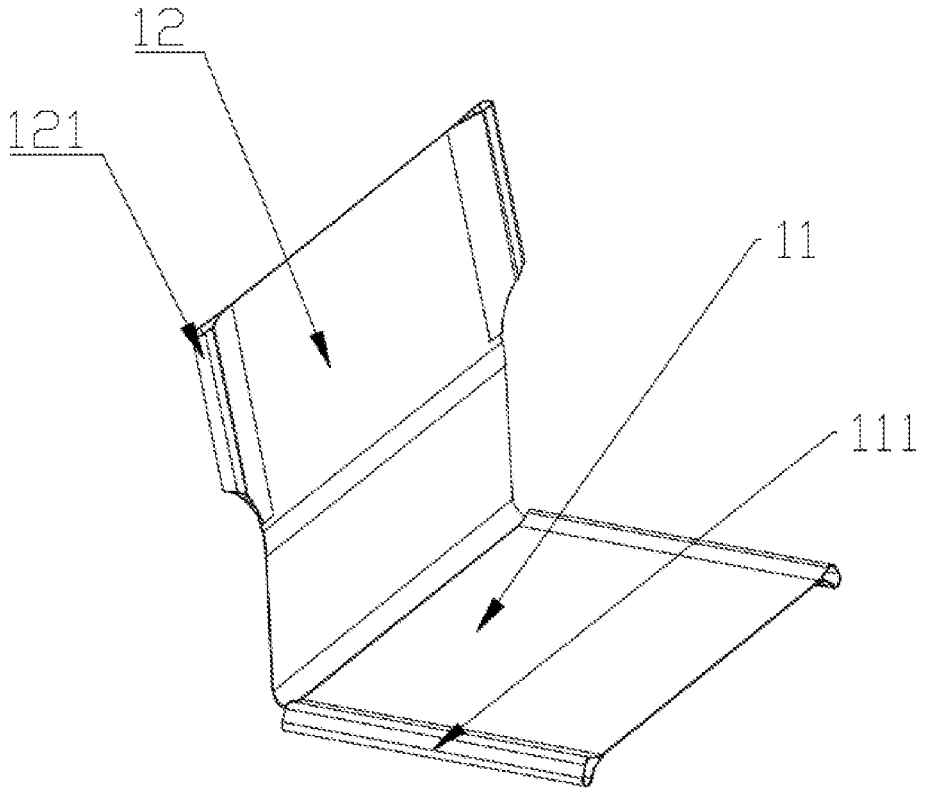
FIG. 3 is a structural view of a chair fabric of the cross rocking chair.
Figure 4:
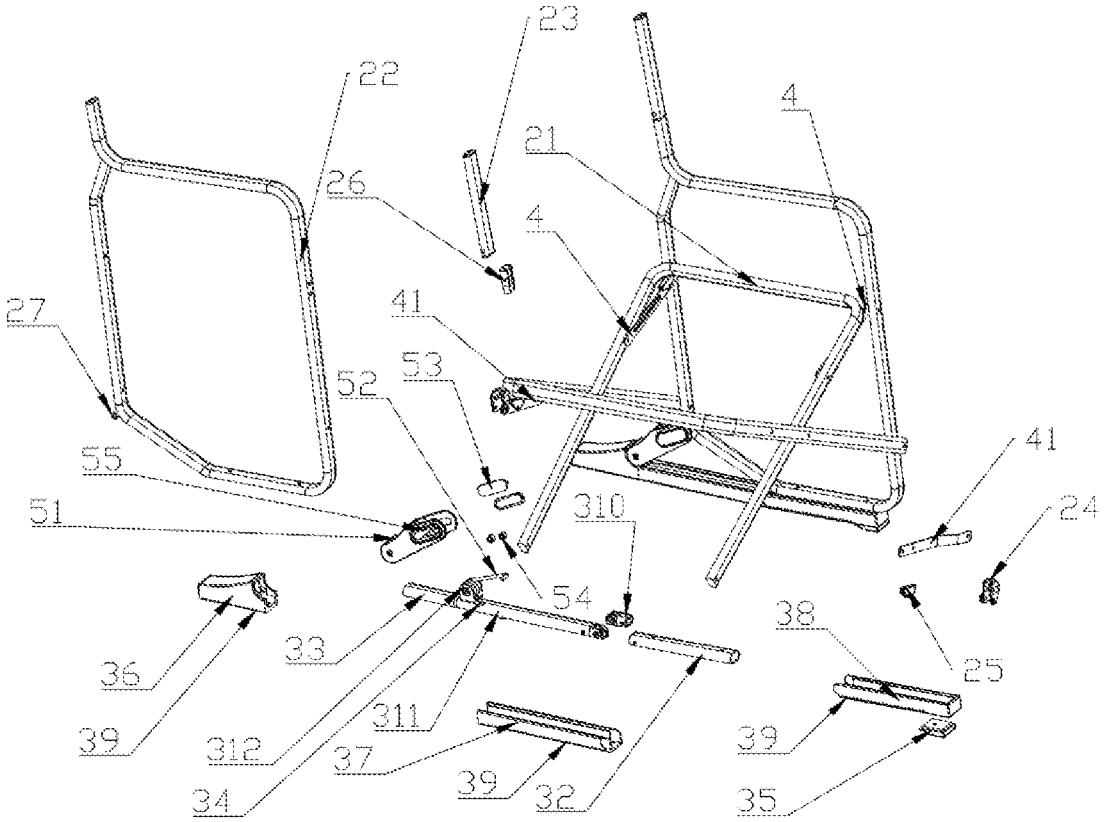
FIG. 4 is a disassembled view of a chair frame of the cross rocking chair.
Figure 5:
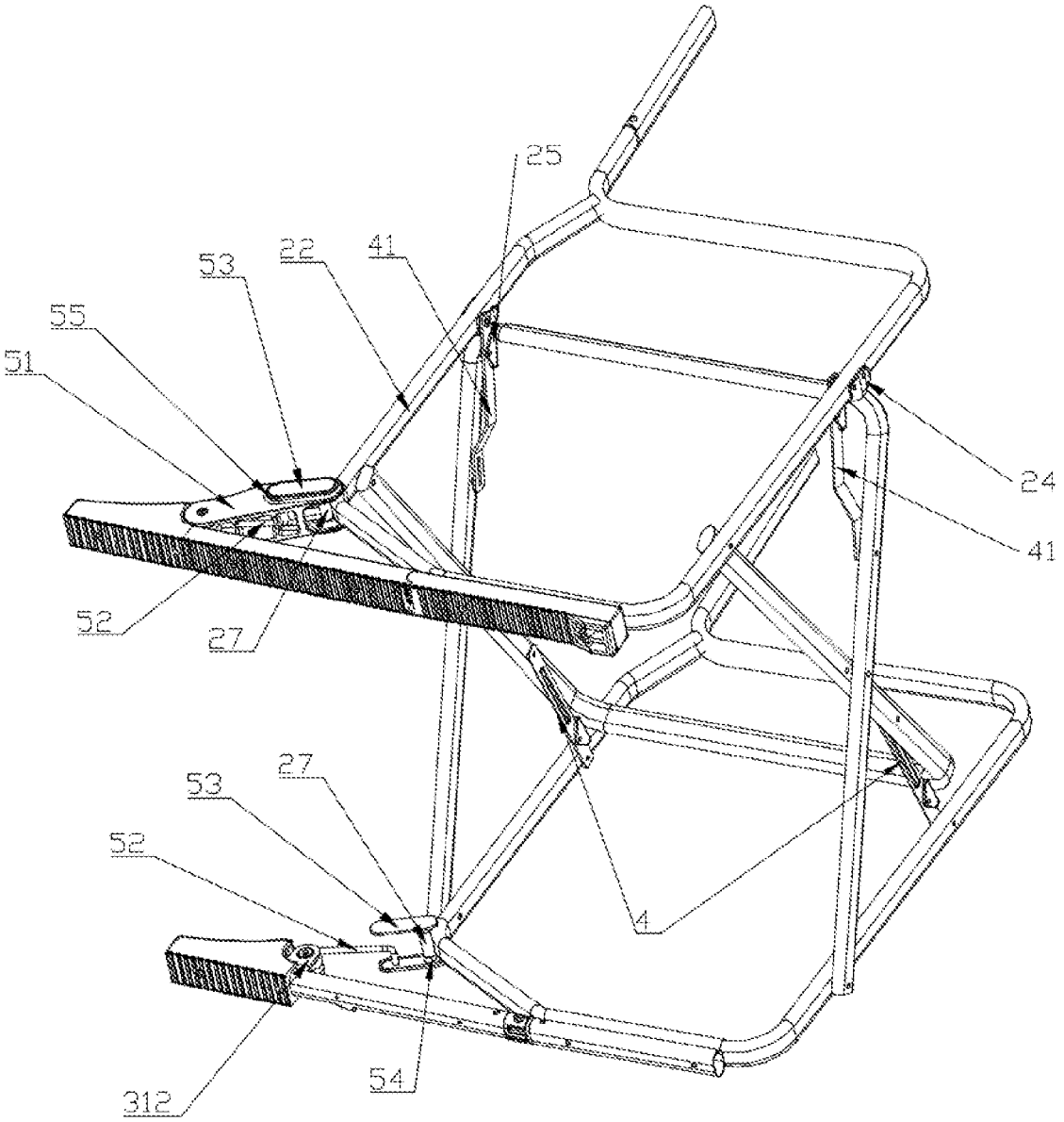
FIG. 5 is an assembled view of the chair frame of the cross rocking chair.

This embodiment discloses a cross rocking chair which is designed in such a manner that a cushion and a backrest in a perpendicular state can be adjusted to a back-tilting state and the tilt angle can be adjusted. As shown in FIG. 1-FIG. 5, the cross rocking chair is mainly composed of a chair fabric 1 and a chair frame, wherein the chair frame is composed of a seat frame assembly 2, a support frame assembly 4 and connectors 5. The chair fabric 1 is disposed around the seat frame assembly 2 in an L shape. Cross tubes 21 are connected in a cross manner and are fixed to a middle portion of the seat frame assembly 1. The support frame assembly 4 is connected to the bottom of the seat frame assembly 2 and is supported on the ground.

In this embodiment, the seat frame assembly 2 comprises two cross tubes 21, two square seat frame armrest tubes 22 and two backrest support tubes 23, wherein the two cross tubes 21 are connected in a cross manner and are then rotatably connected to middle portions of the two seat frame armrest tubes 22, and the top of the rear end of each seat frame armrest tube 22 is connected to one backrest support tube 23 through a back link 26; a cushion 11 and a backrest 12 of the chair fabric 1 are mounted at the upper ends of the cross tubes 21 and the backrest support tubes 23, respectively; the support frame assembly 3 comprises two support frame units, and each support frame unit comprises a support bottom tube 31; the rear ends of bottom tubes of the seat frame armrest tubes 22 are bent upwards, and the front ends of the bottom tubes are disposed on the support bottom tubes 31; and two ends of each connector 5 are rotatably connected to the top of the bent rear end of the bottom tube of one seat frame armrest tube 22 and the rear end of the corresponding support bottom tube 31, respectively.

In a preferred implementation, the back link 26 has an upper contracted portion and a lower contracted portion which are inserted into openings in the tops of the rear ends of one backrest support tube 23 and the corresponding seat frame armrest tube 21, respectively.

In this embodiment, the support frame assembly 3 further comprises rocking chair front pads 35 and rocking chair bottom pads 36, wherein the rocking chair front pads 35 are mounted on the bottom surfaces of the front ends of the support bottom tubes 31, and the rocking chair bottom pads 36 are mounted at the rear ends of the support bottom tubes 31; and when rotating, the bottom tubes of the seat frame armrest tubes abut against the front ends of the support bottom tubes 31 or the upper surfaces of the rocking chair bottom pads 36. Protrusions are arranged at the front ends of the upper surfaces of the rocking chair bottom pads 36, and the rear ends of the rocking chair bottom pads 36 can limit the maximum back-tiling angle by means of the protrusions on the upper surfaces of the rocking chair bottom pads 36.

In a preferred implementation, each support bottom tube 31 comprises a front tube 32, a middle tube 311 and a rear tube 33, wherein the rear tube 33 is inserted into the middle tube 311, and the middle tube 311 is hinged to the front tube 32 through a bottom tube link 310. The rocking chair front pads 35 are disposed at the front ends of the front tubes, and the rocking chair bottom pads 36 are disposed at the rear ends of the rear tubes.

In a preferred implementation, each support frame unit further comprises a front tube pad 38 and a bottom tube pad 37, the front tube pads 38 are disposed around the bottom surfaces of the front tube 32, the rocking chair front pads 35 are arranged at the front ends of the bottom surfaces of the front tube pads 38, and the bottom tube pads 37 are disposed around the bottom surfaces of the middle tubes 33.

To improve the stability of the entire cross rocking chair on the ground, anti-skid grooves 39 are formed in the bottoms of the front tube pads 38, the bottoms of the bottom tube pads 37 and the bottoms of the rocking chair bottom pads 36. The anti-skid grooves 39 increase the frictional force between the cross rocking chair and the ground, thus guaranteeing the stability of the cross rocking chair.

In a preferred implementation, each connector 5 comprises a torsion spring connecting seat 51, a torsion spring 52, bearings 54, a first pin and a second pin; a U-shaped support piece 312 is arranged at the rear end of each support bottom tube 31 and is formed with a mounting hole; each support bottom tube 31 is formed with a notch 35 corresponding to the front end of the U-shaped support piece 31, one end of the torsion spring 52 is located in the notch 35, and the other end of the torsion spring 52 stretches out of the notch 35 to be clamped in the torsion spring connecting seat; and the torsion spring, the lower end of the torsion spring connecting seat and the U-shaped support piece are rotatably connected through the first pin; a small hollow shaft 27 is arranged at the top of the bent portion of each seat frame armrest tube 22, the second pin penetrates through the small hollow shaft 27, two ends of the second pin are provided with the bearings 54 respectively and are mounted in sliding grooves 55 formed in two symmetrical faces of the torsion spring connecting seat 51, and the two sliding grooves 55 are covered with two lateral bearing caps 53 (the first pin and the second pin are shown).

In a preferred implementation, the cross tubes 21 are U-shaped tubes, and two sides of a horizontal rod of each U-shaped tube are riveted to two vertical tubes of one seat frame armrest tube 22, respectively; the chair fabric 1 is an L-shaped structure formed by the backrest 12 and the cushion 11, each of two vertical sleeve tubes 121 on two sides of the backrest 12 is disposed around one backrest support tube, and each of two horizontal sleeve tubes 111 on two sides of the cushion 11 is disposed around one horizontal rod; and two vertical rods of each U-shaped tube are riveted to two vertical tubes of the opposite seat frame armrest tube 22, respectively.

Preferably, the seat frame assembly 2 in this embodiment further comprises four sheaths 24, two connecting metal pieces 4 and two bent metal pieces 41, wherein the sheaths 24 are riveted to the vertical tubes of the seat frame armrest tubes 22, the two sheaths on one seat frame armrest tube 22 are connected to the two bent metal pieces 41, the two sheaths on the other seat frame armrest tube are connected to the two connecting metal pieces 4, the other ends of the two connecting metal pieces 4 are riveted to the two vertical rods of one cross tube, and the other ends of the two bent metal pieces 41 are riveted to the two vertical rods of the other cross tube.

Preferably, the seat frame assembly further comprises four plastic fasteners 25 which are buckled on upper sides of the connecting metal pieces 4 and the bent metal pieces 41, respectively, and when the two cross tubes 21 are unfolded, the horizontal rods of the cross tubes press against the plastic fasteners 25.

In this embodiment, the connecting metal pieces 4 and the bent metal pieces 41 are preferably made of iron or stainless steel.

It should be noted that the above description is merely used to explain preferred embodiments and technical principles of the invention. Those skilled in the art would appreciate that the invention is not limited to these specific embodiments mentioned above, and can make different obvious variation, readjustment and substitutions without departing from the protection scope of the invention. So, although the invention has been explained in detail with reference to the aforesaid embodiments, the invention is not limited to these embodiments and can include more other equivalent embodiments obtained without departing from the concept of the invention, and the scope of the invention should be defined by the appended claims.

What is claimed is:

1. A cross rocking chair, comprising a chair fabric, a seat frame assembly, a support frame assembly and connectors, wherein the seat frame assembly comprises two cross tubes, two square seat frame armrest tubes and two backrest support tubes, the two cross tubes are connected in a cross manner and are then rotatably connected to middle portions of the two seat frame armrest tubes, and a top of a rear end of each said seat frame armrest tube is connected to one said backrest support tube through a back link; a cushion and a backrest of the chair fabric are mounted at upper ends of the cross tubes and the back support tubes, respectively;

the support frame assembly comprises two support frame units each comprising a support bottom tube, rear ends of bottom tubes of the seat frame armrest tubes are bent upwards, front ends of the bottom tubes are arranged on the support bottom tubes, and two ends of each said connector are rotatably connected to a top of the bent rear end of one said seat frame armrest tube and a rear end of the corresponding support bottom tube, respectively; and wherein the support frame assembly comprises rocking chair front pads and rocking chair bottom pads, the rocking chair front pads are mounted on bottom surfaces of front ends of the support bottom tubes and the rear ends of the support bottom tubes, and when rotating, the bottom tubes of the seat frame armrest tubes abut against the front ends of the support bottom tubes or upper surfaces of the rocking chair bottom pads;

wherein each said support tube comprises a front tube, a middle tube and a rear tube, the rear tube is inserted into the middle tube, and the middle tube is hinged to the front tube through a bottom tube link; and the rocking chair front pads are arranged at front ends of the front tubes, and the rocking chair bottom pads are arranged at rear ends of the rear tubes.

2. The cross rocking chair according to claim 1, further comprising front tube pads and bottom tube pads, wherein the front tube pads are disposed around bottom surfaces of the front tubes, the rocking chair front pads are arranged at front ends of bottom surfaces of the front tube pads, and the bottom tube pads are disposed around bottom surfaces of the middle tubes.

3. The cross rocking chair according to claim 2, wherein anti-skid grooves are formed in bottoms of the front tube pads, bottoms of the bottom tube pads and bottoms of the rocking chair bottom pads, respectively.

4. The cross rocking chair according to claim 1, wherein the cross tubes are U-shaped tubes, and two sides of a horizontal rod of each said U-shaped tube are riveted to two vertical tubes of one said seat frame armrest tube, respectively; the chair fabric is an L-shaped structure formed by the backrest and the cushion, each of two vertical sleeve tubes on two sides of the backrest is disposed around one said backrest support tube, and each of two horizontal sleeve tubes on two sides of the cushion is disposed around one said horizontal rod; and two vertical rods of each said U-shaped tube are riveted to two vertical tubes of the opposite seat frame armrest tube, respectively.

5. The cross rocking chair according to claim 1, wherein each said connector comprises a torsion spring connecting seat, a torsion spring, bearings, a first pin and a second pin, and a U-shaped support piece is arranged at the rear end of each said support bottom tube and is formed with a mounting hole; each said support bottom tube is formed with a notch corresponding to a front end of the U-shaped support piece, the torsion spring has an end disposed in the notch and an end stretching out of the notch to be clamped in the torsion spring connecting seat, and the torsion spring, a lower end of the torsion spring connecting seat and the U-shaped support piece are rotatably connected through the first pin;

a small hollow shaft is arranged at a top of the bent portion of each said seat frame armrest tube, the second pin penetrates through the small hollow shafts, and two ends of the second pin are provided with the bearings respectively and are mounted in sliding grooves in two symmetrical faces of the torsion spring connecting seat.

6. The cross rocking chair according to claim 1, wherein each said connector comprises a torsion spring connecting seat, a torsion spring, bearings, a first pin and a second pin, and a U-shaped support piece is arranged at the rear end of each said support bottom tube and is formed with a mounting hole; each said support bottom tube is formed with a notch corresponding to a front end of the U-shaped support piece, the torsion spring has an end disposed in the notch and an end stretching out of the notch to be clamped in the torsion spring connecting seat, and the torsion spring, a lower end of the torsion spring connecting seat and the U-shaped support piece are rotatably connected through the first pin;

a small hollow shaft is arranged at a top of the bent portion of each said seat frame armrest tube, the second pin penetrates through the small hollow shafts, and two ends of the second pin are provided with the bearings respectively and are mounted in sliding grooves in two symmetrical faces of the torsion spring connecting seat.

7. The cross rocking chair according to claim 1, wherein each said connector comprises a torsion spring connecting seat, a torsion spring, bearings, a first pin and a second pin, and a U-shaped support piece is arranged at the rear end of each said support bottom tube and is formed with a mounting hole; each said support bottom tube is formed with a notch corresponding to a front end of the U-shaped support piece, the torsion spring has an end disposed in the notch and an end stretching out of the notch to be clamped in the torsion spring connecting seat, and the torsion spring, a lower end of the torsion spring connecting seat and the U-shaped support piece are rotatably connected through the first pin;

a small hollow shaft is arranged at a top of the bent portion of each said seat frame armrest tube, the second pin penetrates through the small hollow shafts, and two ends of the second pin are provided with the bearings respectively and are mounted in sliding grooves in two symmetrical faces of the torsion spring connecting seat.

8. The cross rocking chair according to claim 2, wherein each said connector comprises a torsion spring connecting seat, a torsion spring, bearings, a first pin and a second pin, and a U-shaped support piece is arranged at the rear end of each said support bottom tube and is formed with a mounting hole; each said support bottom tube is formed with a notch corresponding to a front end of the U-shaped support piece, the torsion spring has an end disposed in the notch and an end stretching out of the notch to be clamped in the torsion spring connecting seat, and the torsion spring, a lower end of the torsion spring connecting seat and the U-shaped support piece are rotatably connected through the first pin;

a small hollow shaft is arranged at a top of the bent portion of each said seat frame armrest tube, the second pin penetrates through the small hollow shafts, and two ends of the second pin are provided with the bearings respectively and are mounted in sliding grooves in two symmetrical faces of the torsion spring connecting seat.

9. The cross rocking chair according to claim 3, wherein each said connector comprises a torsion spring connecting seat, a torsion spring, bearings, a first pin and a second pin, and a U-shaped support piece is arranged at the rear end of each said support bottom tube and is formed with a mounting hole; each said support bottom tube is formed with a notch corresponding to a front end of the U-shaped support piece, the torsion spring has an end disposed in the notch and an end stretching out of the notch to be clamped in the torsion spring connecting seat, and the torsion spring, a lower end of the torsion spring connecting seat and the U-shaped support piece are rotatably connected through the first pin;

a small hollow shaft is arranged at a top of the bent portion of each said seat frame armrest tube, the second pin penetrates through the small hollow shafts, and two ends of the second pin are provided with the bearings respectively and are mounted in sliding grooves in two symmetrical faces of the torsion spring connecting seat.

10. A cross rocking chair, comprising a chair fabric, a seat frame assembly, a support frame assembly and connectors, wherein the seat frame assembly comprises two cross tubes, two square seat frame armrest tubes and two backrest support tubes, the two cross tubes are connected in a cross manner and are then rotatably connected to middle portions of the two seat frame armrest tubes, and a top of a rear end of each said seat frame armrest tube is connected to one said backrest support tube through a back link; a cushion and a backrest of the chair fabric are mounted at upper ends of the cross tubes and the back support tubes, respectively;

the support frame assembly comprises two support frame units each comprising a support bottom tube, rear ends of bottom tubes of the seat frame armrest tubes are bent upwards, front ends of the bottom tubes are arranged on the support bottom tubes, and two ends of each said connector are rotatably connected to a top of the bent rear end of one said seat frame armrest tube and a rear end of the corresponding support bottom tube, respectively;

wherein each said connector comprises a torsion spring connecting seat, a torsion spring, bearings, a first pin and a second pin, and a U-shaped support piece is arranged at the rear end of each said support bottom tube and is formed with a mounting hole; each said support bottom tube is formed with a notch corresponding to a front end of the U-shaped support piece, the torsion spring has an end disposed in the notch and an end stretching out of the notch to be clamped in the torsion spring connecting seat, and the torsion spring, a lower end of the torsion spring connecting seat and the U-shaped support piece are rotatably connected through the first pin; and wherein a small hollow shaft is arranged at a top of the bent portion of each said seat frame armrest tube, the second pin penetrates through the small hollow shafts, and two ends of the second pin are provided with the bearings respectively and are mounted in sliding grooves in two symmetrical faces of the torsion spring connecting seat.

11. A cross rocking chair, comprising a chair fabric, a seat frame assembly, a support frame assembly and connectors, wherein the seat frame assembly comprises two cross tubes, two square seat frame armrest tubes and two backrest support tubes, the two cross tubes are connected in a cross manner and are then rotatably connected to middle portions of the two seat frame armrest tubes, and a top of a rear end of each said seat frame armrest tube is connected to one said backrest support tube through a back link; a cushion and a backrest of the chair fabric are mounted at upper ends of the cross tubes and the back support tubes, respectively;

the support frame assembly comprises two support frame units each comprising a support bottom tube, rear ends of bottom tubes of the seat frame armrest tubes are bent upwards, front ends of the bottom tubes are arranged on the support bottom tubes, and two ends of each said connector are rotatably connected to a top of the bent rear end of one said seat frame armrest tube and a rear end of the corresponding support bottom tube, respectively; and wherein the seat frame assembly further comprises four sheaths, two connecting metal pieces and two bent metal pieces, the sheaths are riveted on vertical tubes of the seat frame armrest tubes, the two sheaths on one said seat frame armrest tube are connected to the two bent metal pieces, the two sheaths on the other seat frame armrest tubes are connected to the two connecting metal pieces, another ends of the two connecting metal pieces are riveted to two vertical rods of one said cross tube, and another ends of the two bent metal pieces are riveted to vertical rods of the other cross tube.

12. The cross rocking chair according to claim 11, wherein the seat frame assembly further comprises four plastic fasteners which are buckled on upper sides of the connecting metal pieces and the bent metal pieces, respectively, and when the two cross tubes are unfolded, horizontal rods of the cross tubes press against the plastic fasteners.

* * * * *